US012714266B1

(12) United States Patent
McClure

(10) Patent No.: US 12,714,266 B1
(45) Date of Patent: Aug. 25, 2026

(54) TOILET PAPER DUST REMOVAL AND DEODORIZING APPARATUS

(71) Applicant: Robert McClure, Topeka, KS (US)

(72) Inventor: Robert McClure, Topeka, KS (US)

( * ) Notice: Subject to any disclaimer, the term of this patent is extended or adjusted under 35 U.S.C. 154(b) by 0 days.

(21) Appl. No.: 19/400,890

(22) Filed: Nov. 25, 2025

(51) Int. Cl.
*A47K 10/22* (2006.01)
*A47K 10/38* (2006.01)

(52) U.S. Cl.
CPC ..... *A47K 10/22* (2013.01); *A47K 10/38* (2013.01); *A47K 2010/389* (2013.01)

(58) Field of Classification Search
CPC ..... A47K 10/00; A47K 10/025; A47K 10/16–22; A47K 10/24–28; A47K 10/32; A47K 10/34–3643; A47K 10/38–3845; A47K 10/40–427; A47K 2010/322–326; A47K 2010/3854–389; B08B 5/04; E03D 9/04
See application file for complete search history.

(56) References Cited

U.S. PATENT DOCUMENTS

| | | | | | |
|---|---|---|---|---|---|
| 4,223,964 | A * | 9/1980 | Kilgore | A47K 10/3836 | 312/34.19 |
| 4,770,679 | A * | 9/1988 | Slaughter | A47K 10/32 | 55/315 |
| 10,426,300 | B1 * | 10/2019 | Young | A47K 10/3836 | |
| 2009/0045083 | A1 * | 2/2009 | Vaults, Jr. | A47K 17/00 | 206/391 |

FOREIGN PATENT DOCUMENTS

| | | | | |
|---|---|---|---|---|
| CN | 204722953 | * 10/2015 | A47K 10/18 | |
| CN | 105942910 | * 9/2016 | A47K 10/22 | |
| KR | 20040030017 | * 4/2004 | A47K 10/34 | |
| KR | 20160039075 | * 4/2016 | B01D 46/0028 | |
| KR | 102676934 | * 6/2024 | A47K 10/36 | |

* cited by examiner

*Primary Examiner* — David P Angwin
*Assistant Examiner* — Nicholas A Ros
(74) *Attorney, Agent, or Firm* — Dale J. Ream

(57) ABSTRACT

An apparatus and method are provided for removing and capturing dust generated during dispensing of toilet paper from a roll. The apparatus includes a pedestal framework supporting a toilet paper roll holder at an upper portion thereof. The framework includes upright channel members having perforations configured to draw toilet paper dust into an interior area when a vacuum motor is activated. A motion sensor detects movement of the toilet paper roll and triggers operation of the vacuum motor to suction the dust through a filter and into a collection area. Exhaust air from the vacuum motor passes through a deodorizer compartment to emit a fresh scent into the surrounding air. The apparatus may be powered by a rechargeable battery and the filter and deodorizer are replaceable.

16 Claims, 6 Drawing Sheets

TOILET PAPER DUST REMOVAL AND DEODORIZING APPARATUS

BACKGROUND OF THE INVENTION

In bathrooms and other sanitary facilities, toilet paper rolls are commonly dispensed from wall-mounted or free-standing holders. During removal of sheets from a toilet paper roll, small particles and paper dust are released into the surrounding air. These fine dust particles may settle on nearby surfaces, contribute to air impurities, and aggravate respiratory sensitivities in individuals. Despite advances in bathroom hygiene and air purification, little attention has been directed toward managing toilet paper dust produced during everyday use.

Conventional toilet paper holders merely support the roll and allow it to rotate for dispensing. While some bathroom fixtures include built-in air fresheners or lighting, none provide an integrated means to remove or capture paper dust generated during the tearing or unrolling of toilet paper. As a result, users may experience visible dust accumulation around the toilet area, leading to a less hygienic environment and the need for frequent cleaning.

There exists a continuing need, therefore, for an apparatus capable of capturing and filtering dust released from toilet paper rolls as sheets are dispensed. Such an apparatus should be compact, quiet in operation, and capable of operating automatically only when necessary. Preferably, it should also provide deodorizing capability to improve overall bathroom air freshness while maintaining a visually appealing design that complements typical bathroom décor.

SUMMARY OF THE INVENTION

Accordingly, an integrated toilet paper dust removal and deodorizing apparatus includes a pedestal framework, a toilet paper roll holder, a vacuum motor, and a deodorizer system. The toilet paper roll holder is supported atop the pedestal framework, which includes upright channel members defining a hollow interior area. The upright channel members include a series of perforations through which air and toilet paper dust are drawn when the vacuum motor is energized.

A motion sensor is provided on or near the roll holder to detect movement of the toilet paper roll indicative of dispensing or tearing action. Upon detection, the sensor actuates the vacuum motor located within the pedestal framework. The motor generates suction that draws dust through the perforations or holes, into the hollow interior, and through a replaceable filter where dust is collected. Filtered air is then directed through a deodorizer compartment positioned proximate the vacuum motor to emit a deodorizing scent into the surrounding atmosphere. The deodorizer compartment may include a refill access door for easy replenishment. The vacuum motor may be powered by a rechargeable battery contained within the pedestal framework.

The apparatus thereby provides a convenient and sanitary solution to an overlooked problem—removing toilet paper dust at the moment it is generated—while simultaneously improving air quality and odor control in bathrooms.

Therefore, a general object of the present invention is to provide an apparatus configured to remove and capture toilet paper dust generated during dispensing or tearing of toilet paper from a roll.

Another object of the invention is to provide a toilet paper dust removal apparatus that operates automatically upon detection of movement of the toilet paper roll.

A further object of the invention is to provide a toilet paper holder having an integrated vacuum system and filter for collecting and retaining dust particles.

Still another object of the invention is to provide a toilet paper dust removal apparatus including a deodorizer system configured to emit a fresh scent into ambient air as filtered air is exhausted.

Yet another object of the invention is to provide an apparatus that is simple in construction, economical to manufacture, and convenient to maintain through replaceable filters and refillable deodorizer cartridges.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
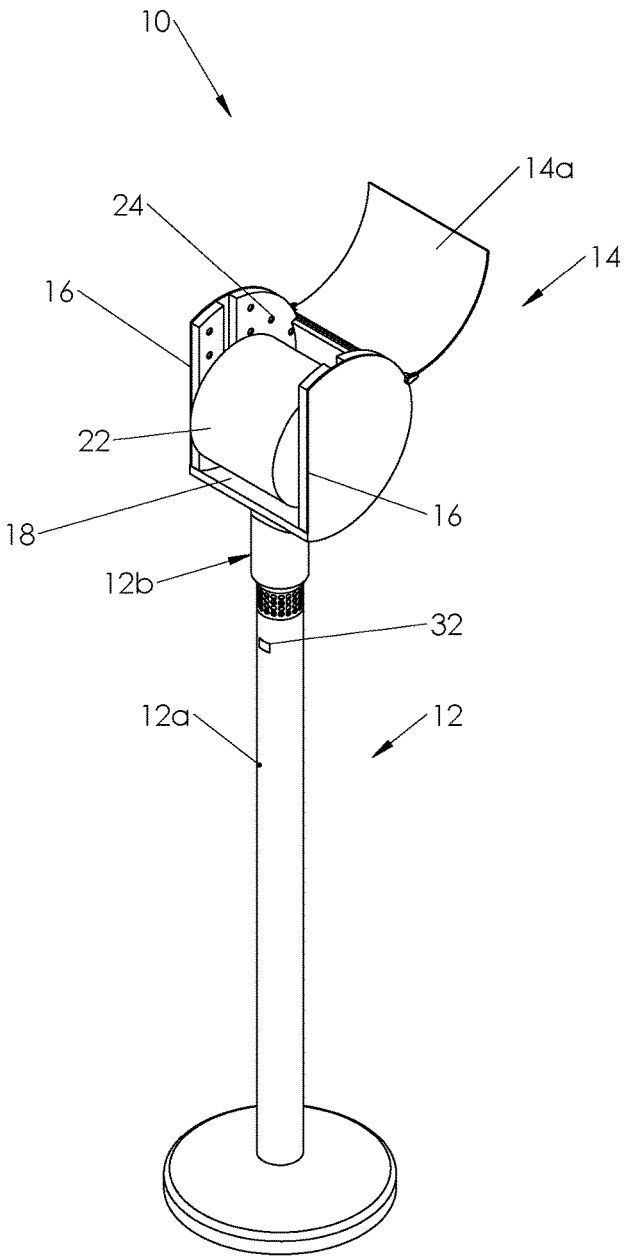
FIG. 1*a* is a front perspective view of a toilet paper dust control and deodorizing apparatus according to the present invention, illustrated with an access door in an open configuration.
Figure 1B:
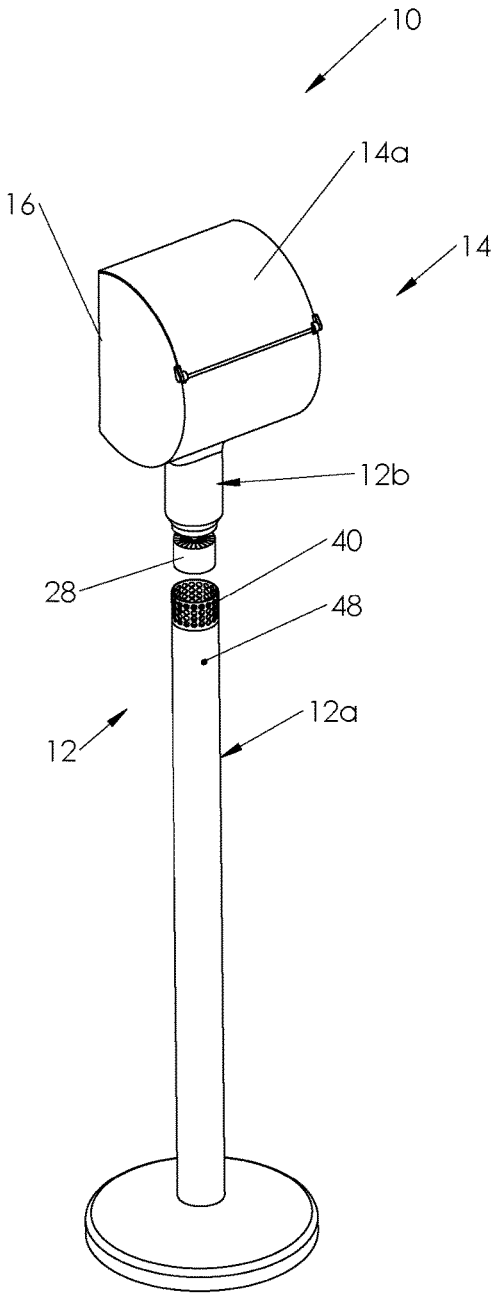
FIG. 1*b* is a rear perspective view of the dust control apparatus according to the present invention, illustrated with the access door in a closed configuration.
Figure 2A:
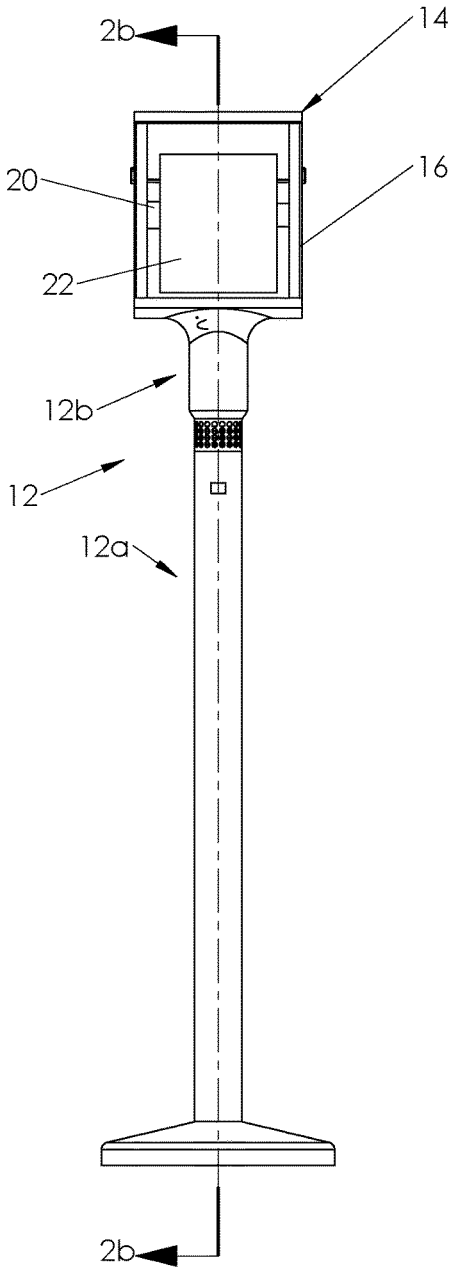
FIG. 2*a* is a front view of the dust control apparatus as in FIG. 1*a;*
Figure 2B:
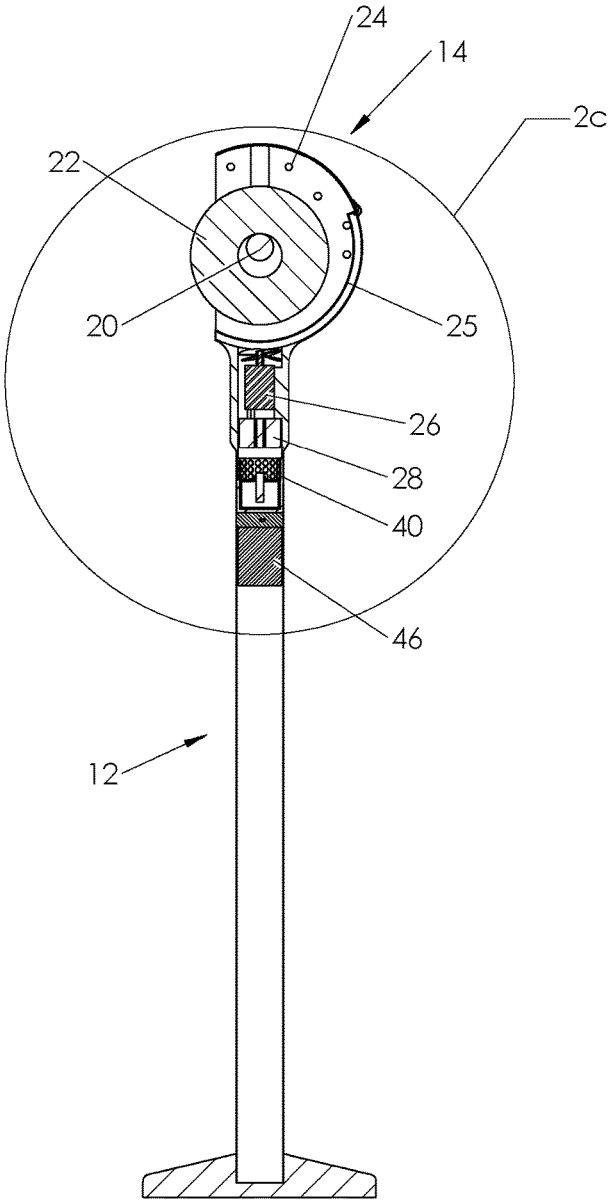
FIG. 2*b* is a sectional view taken along line 2*b*-2*b* of FIG. 2*a;*
Figure 2C:
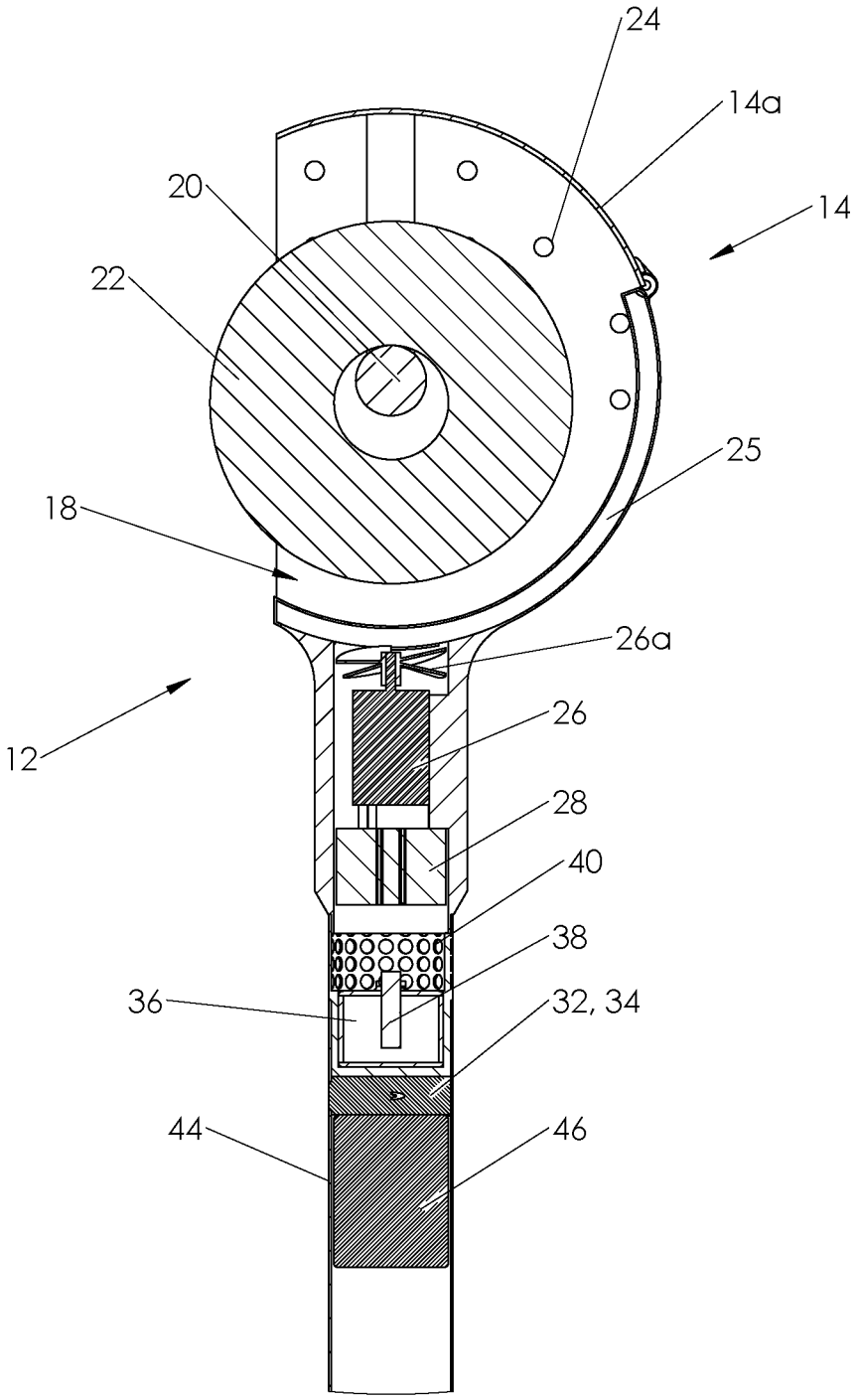
FIG. 2*c* is an isolated view on an enlarged scale taken from FIG. 2*b;*
Figure 3:
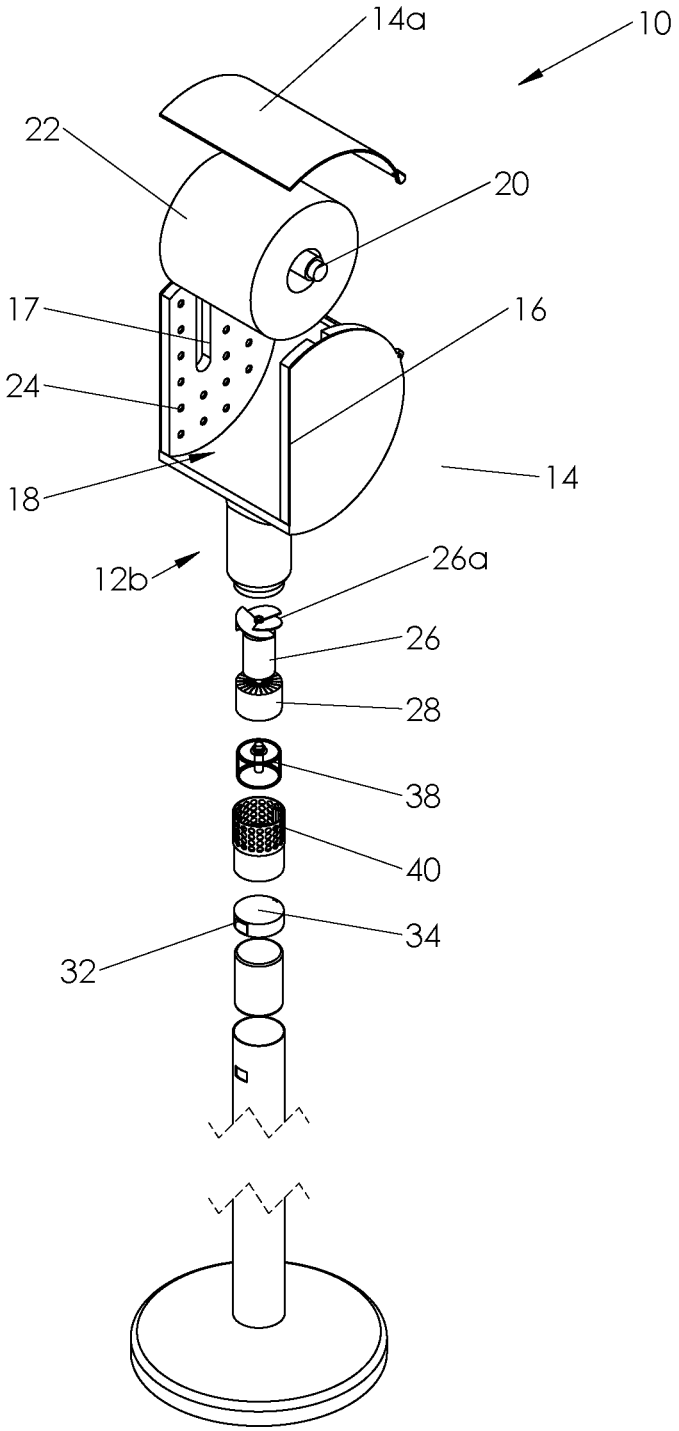
FIG. 3 is an exploded view of the dust control apparatus as in FIG. 1*a;*
Figure 4A:
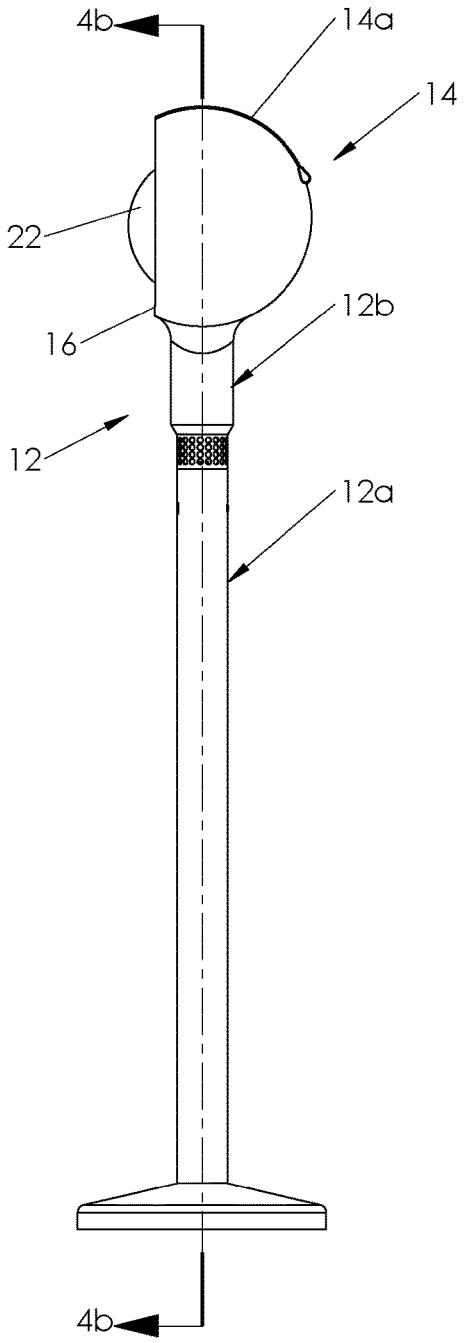
FIG. 4*a* is a side view of the dust control apparatus as in FIG. 1*b;*
Figure 4B:
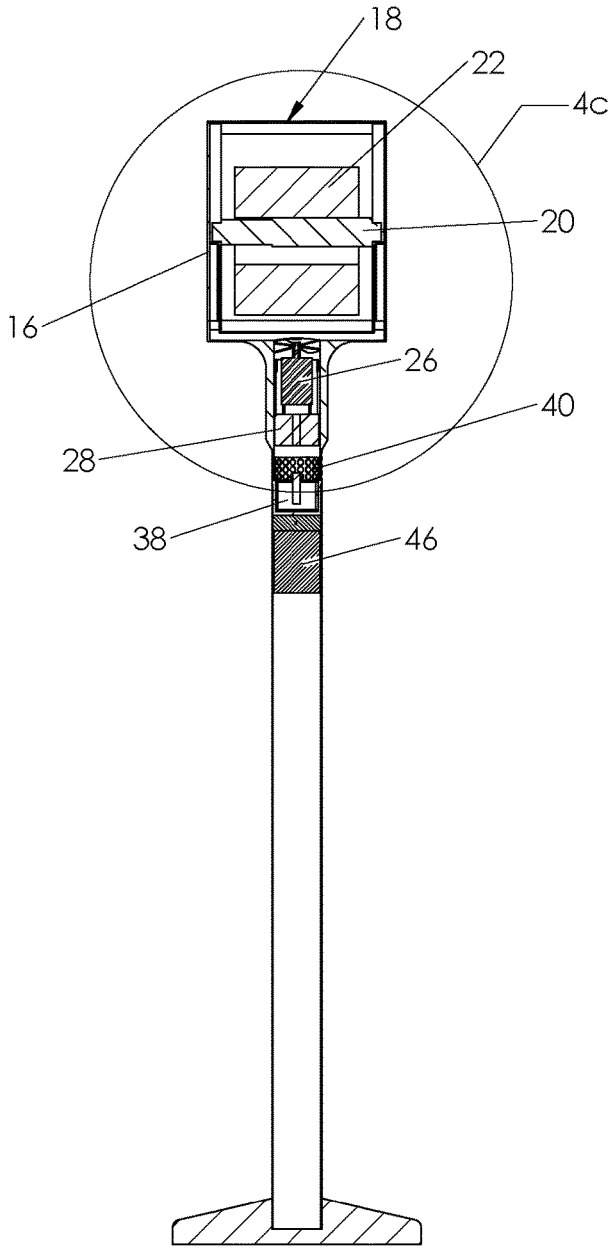
FIG. 4*b* is a sectional view taken along line 4*b*-4*b* of FIG. 4*a*.
Figure 4C:
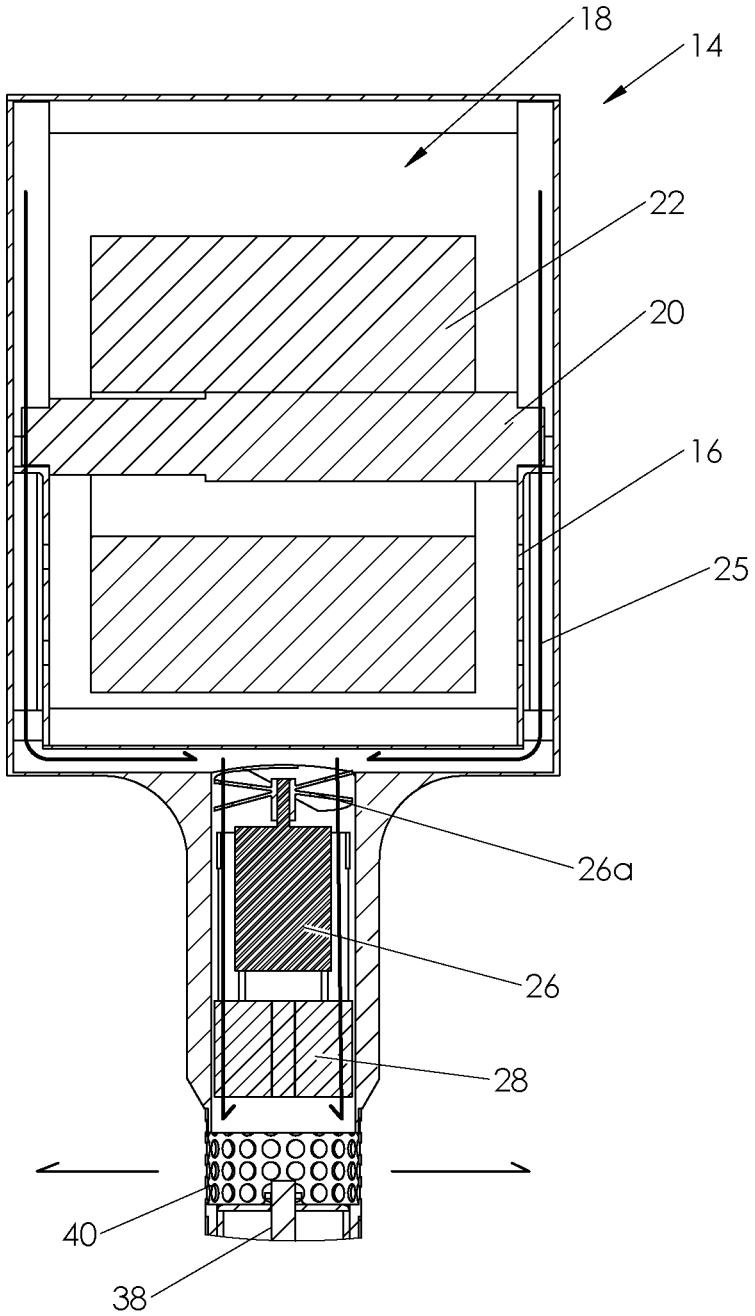
FIG. 4*c* is an isolated view on an enlarged scale taken from FIG. 4*b*, it illustrated using arrows to show a flow of air through the apparatus.

Referring now to the drawings, the present invention is directed to a toilet paper dust removal and deodorizing apparatus 10 configured to capture and filter fine dust particles released from toilet paper rolls during normal use.

The apparatus 10 includes a pedestal framework 12 defining a lower portion 12*a* and an upper portion 12*b*, the portions being separable from one another as will be described in more detail later. The pedestal framework 12 is preferably of tubular or columnar construction to provide internal space for housing functional components. The upper portion 12*b* of the pedestal framework 12 supports a U-shaped topper 14 constructed of a pair of upright channel members 16 joined at their lower ends to the pedestal framework 12. In an embodiment, the upright channel members 16 may include walls that define a hollow interior area 18 extending downwardly into the pedestal interior or is it communication therewith. In an embodiment, the topper 14 may be operable and configured as a housing that may be closed and sealed so as to hold a vacuum when ambient air is removed therefrom. Further, the topper 14 may include an access door 14*a* which must be pivotally opened for a user to access a toilet paper roll 22. A toilet paper roll holder 20 extends between the upright channel members 16 and is configured to rotatably support a toilet paper roll 22 for normal dispensing of toilet paper sheets. An inner surface of respective walls (i.e., of the upright channel members 16) may define a recessed area 17 or a groove that is configured to receive respective ends of the paper roll holder 20 in a manner that is traditional and understood by users when changing a roll of toilet paper 22.

Each upright channel member 16 (i.e., inner walls of the topper 14) includes a plurality of perforations 24 or small openings distributed along its inner surfaces adjacent to the toilet paper roll 22. These perforations 24 are sized and configured to permit fine paper dust to pass therethrough while minimizing airflow interference with normal toilet paper dispensing. The perforations 24 are in operative communication with the hollow interior area 18, which in turn is fluidly connected to a vacuum motor 26 disposed within an upper chamber of the pedestal framework 12. In an embodiment, the vacuum motor 26 may be electrically connected to a battery 46 as a power source. Also, the topper 14 may include or define an inner chamber 25 (previously mentioned above) that is in communication with the plurality of perforations (i.e., the holes) 24, the inner chamber 25 being in fluid communication with the interior space of an upper end of the lower portion 12*a* of the pedestal framework 12.

The vacuum motor 26 may be integrally or operatively electrically connected to a fan 26*a* which, together, may be configured to generate suction airflow through the perforations 24 and into the inner chamber 25 of the hollow interior area 18. Interposed between the upright channel members 16 and the vacuum motor 26 is a filter 28, such as a removable and replaceable particulate filter, that captures and retains toilet paper dust particles. The filter 28 may be accessed through a filter access panel formed in a rear or side wall of the pedestal framework 12 to facilitate filter replacement and cleaning. More particularly and as shown in the drawings, the upper and lower portions 12*a* and 12*b* may be frictionally or mechanically separated so that the filter 28 may be accessed, replaced, or the like. In fact, disconnecting the upper and lower portions also enables access to the interior or tubular space such as for replacement of other components described herein. In an alternative embodiment, the pedestal framework 12 a base portion containing a removable collection bin configured to receive and retain dust particles collected by the filter.

A motion sensor 32 may be mounted on or near the topper 14 and oriented toward the toilet paper roll 22. The motion sensor 32 may comprise an infrared, optical, or proximity-type sensor configured to detect rotation or disturbance of the toilet paper roll 22 indicative of a dispensing or tearing event. Upon detection of such motion, the sensor 32 sends an activation signal to a controller 34 located within the pedestal framework 12. The controller 34 energizes the vacuum motor 26 for a predetermined period sufficient to draw airborne dust into the filter 28 and then automatically deactivates the motor 26 is to conserve power.

The vacuum motor 26 is further configured to direct its exhaust airflow through a deodorizer compartment 36 positioned adjacent the motor housing. The deodorizer compartment 36 contains a replaceable or refillable deodorizing medium 38, such as a gel cartridge, scented pad, or essential oil reservoir. The exhaust airflow passing over or through the deodorizer compartment 36 releases a deodorized exhaust flow into ambient air surrounding the pedestal framework 12. In an embodiment, an air discharge manifold 40 may be positioned proximate the motor 26 and may define a plurality of holes or perforations that enable an outflow of deodorant scent as discharge from the motor 26 encounters the deodorizing medium 38. The deodorizer compartment 36 may include a refill access door allowing a user to replenish or replace the deodorant element or, as described above, the upper and lower portions of the pedestal framework 12 may be frictionally or mechanically separated so as to provide access.

The pedestal framework 12 may also include an internal battery compartment 44 housing a rechargeable battery 46 configured to supply electrical power to the vacuum motor 26, controller 34, and motion sensor 32. A charging port 48 or inductive charging interface may be provided externally for convenient recharging of the battery 46 as would be understood by persons of ordinary skill in the art.

In operation, when a user grasps and tears a sheet from the toilet paper roll 22, the motion sensor 32 detects the roll movement and signals the controller 34 to activate the vacuum motor 26. Airborne dust generated during this action is immediately drawn through the perforations 24 and hollow interior area 18 into the filter 28. The vacuum motor 26 maintains suction for a short duration, capturing residual dust before automatically shutting off. Simultaneously, filtered air is exhausted through the deodorizer compartment 36, diffusing a pleasant scent into the surrounding environment. The flow of air through the apparatus 10 is illustrated in FIG. 6.

The apparatus 10 thus provides a sanitary, energy-efficient, and user-friendly means for mitigating toilet paper dust accumulation while adding air freshening functionality to a conventional toilet paper holder design. Various modifications, such as multiple filter stages, sound-dampening structures, or wireless sensor communication, may be employed without departing from the spirit and scope of the invention.

It is understood that while certain forms of this invention have been illustrated and described, it is not limited thereto except insofar as such limitations are included in the following claims and allowable functional equivalents thereof.

What is claimed is:

1. An apparatus for removing and capturing dust generated during removal of toilet paper from a toilet paper roll, comprising:

a pedestal framework having an upper portion and a lower portion;

a toilet paper roll holder coupled to the upper portion of the pedestal framework and configured to rotatably support a toilet paper roll;

a pair of upright channel members extending upwardly from the pedestal framework and defining a hollow interior area, each of the upright channel members defining a plurality of perforations;

a vacuum motor disposed within the pedestal framework and fluidly connected to the hollow interior area of the upright channel members such that the vacuum motor, when energized, produces suction through the perforations to draw dust from the toilet paper roll into the interior area; and a filter disposed in the lower portion of the pedestal framework and downstream of the plurality of perforations that is configured to capture toilet paper dust drawn therethrough.

2. The apparatus of claim 1, wherein the upright channel members and the toilet paper roll holder, together, form a generally U-shaped topper mounted to the upper portion of the pedestal framework.

3. The apparatus of claim 1, wherein the vacuum motor is powered by a rechargeable battery disposed within the lower portion of the pedestal framework.

4. The apparatus of claim 1, wherein the filter comprises a removable and replaceable particulate filter accessible when the upper and lower portions of the pedestal framework are frictionally separated.

5. The apparatus of claim 1, wherein the pedestal framework comprises a base portion containing a removable collection bin configured to receive and retain dust particles separated by the filter.

6. The apparatus of claim 1, further comprising a controller operatively coupled to the vacuum motor and the motion sensor, the controller being programmed to energize the vacuum motor for a predetermined duration upon detection of motion.

7. The apparatus of claim 1, further comprising a motion sensor operatively coupled to the pedestal framework proximate the interior area and configured to actuate the vacuum motor in response to detection of motion of the toilet paper roll indicative of a dispensing or tearing action.

8. The apparatus of claim 7, wherein the motion sensor comprises an infrared or optical sensor directed toward the toilet paper roll.

9. The apparatus of claim 1, further comprising a deodorizer compartment positioned proximate the vacuum motor and arranged such that exhaust air from the vacuum motor passes over or proximate the deodorizer compartment to emit a deodorizing scent into ambient air.

10. The apparatus of claim 9, wherein the deodorizer compartment is accessible to a user so as to permit replacement of a deodorizing medium disposed therein.

11. A method for removing and capturing dust generated during dispensing of toilet paper from a toilet paper roll, comprising:

supporting a toilet paper roll upon a roll holder coupled to a pedestal framework having a pair of upright channel members defining a plurality of perforations;

detecting motion of the toilet paper roll indicative of a dispensing or tearing event;

in response to the detected motion, activating a vacuum motor disposed within the pedestal framework to draw air and toilet paper dust through the perforations and into a hollow interior area of the upright channel members;

filtering the drawn air through a filter disposed proximate the upright channel members and the vacuum motor to capture toilet paper dust; and exhausting filtered air through a deodorizer compartment to discharge a deodorizing scent into surrounding ambient air.

12. The method of claim 11, further comprising automatically deactivating the vacuum motor after a predetermined time interval following detection of motion.

13. The method of claim 11, wherein detecting motion comprises sensing movement of the toilet paper roll using a motion or proximity sensor.

14. The method of claim 11, further comprising recharging a battery configured to power the vacuum motor.

15. The method of claim 11, further comprising periodically removing and replacing the filter to maintain suction efficiency.

16. The method of claim 11, further comprising replenishing the deodorizer compartment formed in the pedestal framework.

* * * * *